US012392217B2

(12) United States Patent
Varhaug et al.

(10) Patent No.: US 12,392,217 B2
(45) Date of Patent: Aug. 19, 2025

(54) TOOLSTRING AND METHOD FOR INNER CASING PERFORATING, SHATTERING ANNULUS CEMENT, AND WASHING THE FIRST ANNULUS IN A SECOND CASING

(71) Applicant: Archer Oiltools AS, Stavanger (NO)

(72) Inventors: Jarle Varhaug, Ålgård (NO); Andreas Fliss, Stavanger (NO); Bjørn Tore Torvestad, Stavanger (NO)

(73) Assignee: ARCHER OILTOOLS AS, Stavanger (NO)

( * ) Notice: Subject to any disclaimer, the term of this patent is extended or adjusted under 35 U.S.C. 154(b) by 0 days.

(21) Appl. No.: 18/290,411

(22) PCT Filed: May 11, 2022

(86) PCT No.: PCT/NO2022/050105
§ 371 (c)(1),
(2) Date: Nov. 13, 2023

(87) PCT Pub. No.: WO2022/240295
PCT Pub. Date: Nov. 17, 2022

(65) Prior Publication Data

US 2024/0247564 A1 Jul. 25, 2024

(30) Foreign Application Priority Data

May 11, 2021 (NO) ..... 20210594

(51) Int. Cl.
*E21B 37/00* (2006.01)
*E21B 33/13* (2006.01)
(Continued)

(52) U.S. Cl.
CPC ..... *E21B 33/14* (2013.01); *E21B 33/13* (2013.01); *E21B 37/00* (2013.01); *E21B 43/117* (2013.01);
(Continued)

(58) Field of Classification Search
None
See application file for complete search history.

(56) References Cited

U.S. PATENT DOCUMENTS 4,253,523 A 3/1981 Ibsen
4,349,073 A * 9/1982 Zublin ..... E21B 37/00 166/73
(Continued)

FOREIGN PATENT DOCUMENTS

NO 20111641 A1 7/2012
NO 20131131 A1 2/2015
(Continued)

OTHER PUBLICATIONS

Bizley, "Subsea P&A," Energy Global, https://www.energyglobal.com/upstream/special-reports/07052015/subsea-panda/, May 7, 2015, 12 pages total.
(Continued)

*Primary Examiner* — Kenneth L Thompson
(74) *Attorney, Agent, or Firm* — Birch, Stewart, Kolasch & Birch, LLP

(57) ABSTRACT

A method of sealing a partly or entirely annulus-cemented casing portion of a first casing in a second casing in a petroleum well, includes running a drill pipe string-conveyed perforating gun with a cement shattering device into said well; positioning said perforating gun at said cemented casing portion and activating first, shallow-perforating charges to make first, shallow perforations through said casing portion into thus making a perforated, cement-filled annulus portion and leaving said second casing intact; activating said cement shattering device to disintegrate all or part of said cement within said first perforated annulus portion; running a washing tool along said perforated casing portion, washing out said shattered cement from said perforated annulus portion. The washed-out casing portion may
(Continued)

then be cut using a cutter tool and pulled out of hole, or cemented using a cementing tool, or a combination thereof.

37 Claims, 16 Drawing Sheets

(51) Int. Cl.

| | |
|---|---|
| ***E21B 33/14*** | (2006.01) |
| ***E21B 43/11*** | (2006.01) |
| ***E21B 43/117*** | (2006.01) |
| ***E21B 43/1185*** | (2006.01) |
| ***E21B 43/119*** | (2006.01) |

(52) U.S. Cl.
CPC ..... *E21B 43/1185* (2013.01); *E21B 43/1193* (2020.05)

(56) References Cited

U.S. PATENT DOCUMENTS

| | | | | |
|---|---|---|---|---|
| 5,775,426 | A | 7/1998 | Snider et al. | |
| 7,913,761 | B2 | 3/2011 | Pratt et al. | |
| 8,584,756 | B1 * | 11/2013 | Barlow | E21B 33/14 166/250.12 |
| 9,334,712 | B2 * | 5/2016 | Bakken | E21B 37/00 |
| 9,416,636 | B2 * | 8/2016 | Myhre | E21B 33/13 |
| 9,695,671 | B2 * | 7/2017 | Myhre | E21B 33/134 |
| 10,260,311 | B2 * | 4/2019 | Myhre | E21B 43/11 |
| 10,612,343 | B2 * | 4/2020 | Hess | E21B 43/045 |
| 10,648,279 | B2 * | 5/2020 | Shafer | E21B 29/02 |
| 11,136,862 | B2 * | 10/2021 | Watts | E21B 37/00 |
| 11,261,704 | B2 * | 3/2022 | Anderson | E21B 43/116 |
| 12,146,389 | B2 * | 11/2024 | Luell | E21B 37/08 |
| 2003/0037692 | A1 | 2/2003 | Liu | |
| 2007/0095529 | A1 | 5/2007 | Bond et al. | |
| 2011/0203795 | A1 * | 8/2011 | Murphy | C09K 8/467 166/135 |
| 2013/0312963 | A1 | 11/2013 | Larsen et al. | |
| 2014/0138078 | A1 * | 5/2014 | Lerbrekk | E21B 29/02 166/55 |
| 2017/0067313 | A1 * | 3/2017 | Connell | E21B 34/06 |
| 2018/0135372 | A1 * | 5/2018 | DeGeare | E21B 33/134 |
| 2020/0115981 | A1 | 4/2020 | Chapman et al. | |
| 2020/0165896 | A1 | 5/2020 | Skeels et al. | |

FOREIGN PATENT DOCUMENTS

| | | | |
|---|---|---|---|
| NO | 20181388 | A1 | 1/2019 |
| WO | WO 2012/105852 | A1 | 8/2012 |
| WO | WO 2015/026239 | A2 | 2/2015 |
| WO | WO 2020/208327 | A1 | 10/2020 |
| WO | WO 2020/256563 | A1 | 12/2020 |

OTHER PUBLICATIONS

Great Britain Office Action for Great Britain Application No. GB2206905.8, dated Dec. 27, 2023.
International Preliminary Report on Patentability, issued in PCT/NO2022/050105, PCT/IPEA/409, dated Mar. 27, 2023.
International Search Report, issued in PCT/NO2022/050105, PCT/ISA/210, dated Oct. 5, 2022.
Written Opinion of the International Searching Authority, issued in PCT/NO2022/050105, PCT/ISA/237, dated Oct. 5, 2022.

* cited by examiner separate perf gun and shatter gun

Combined perf gun and shatter gun shatter gun displaced and given delayed activation shatter gun triggered by perf gun

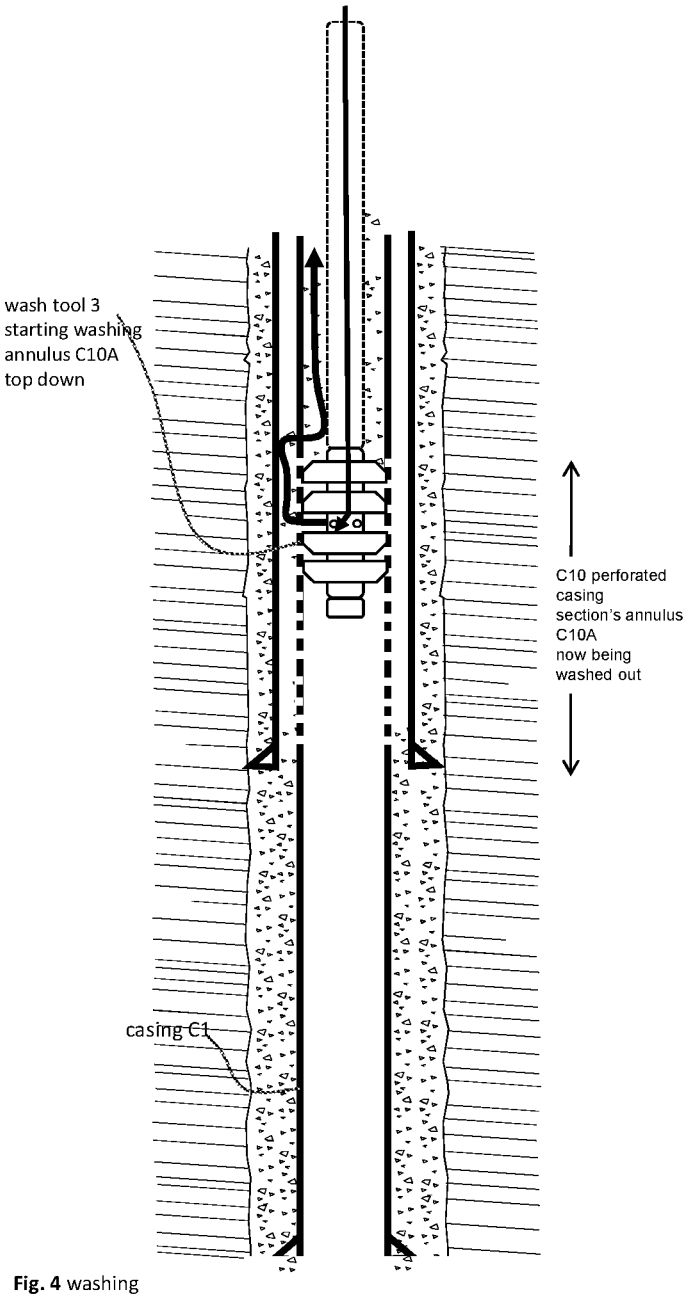
Fig. 4 washing downwardly

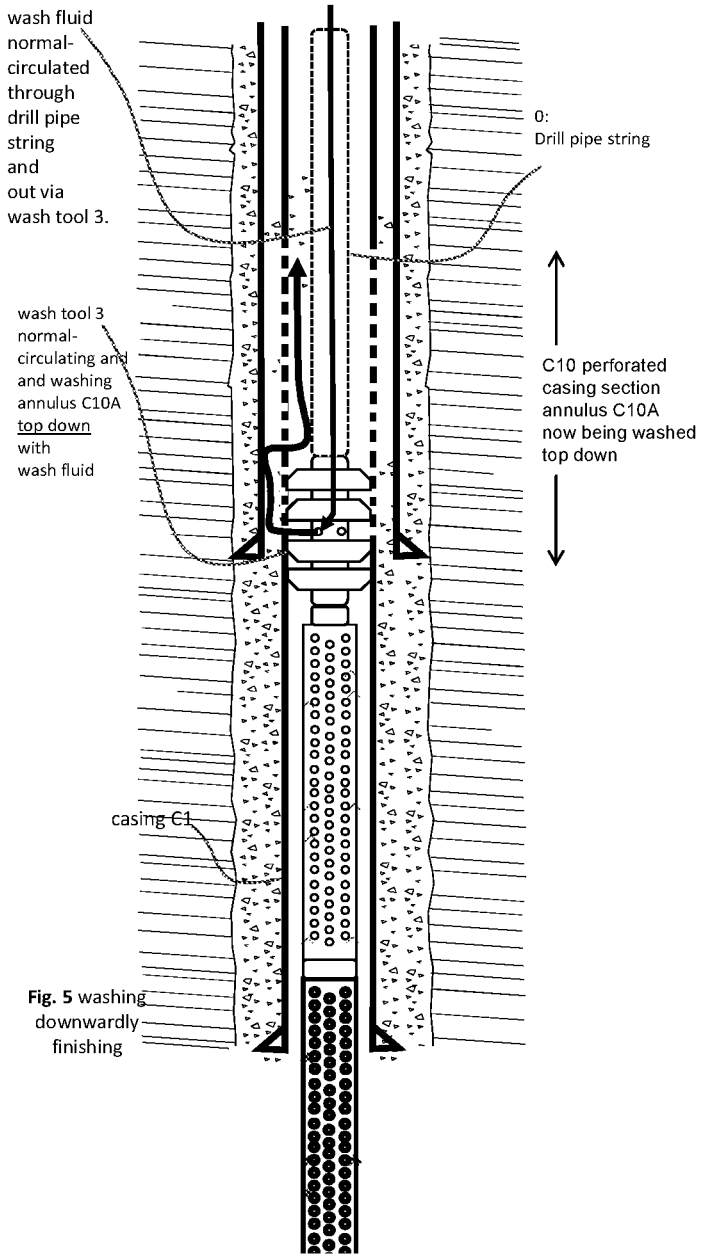
Fig. 5 washing downwardly finishing

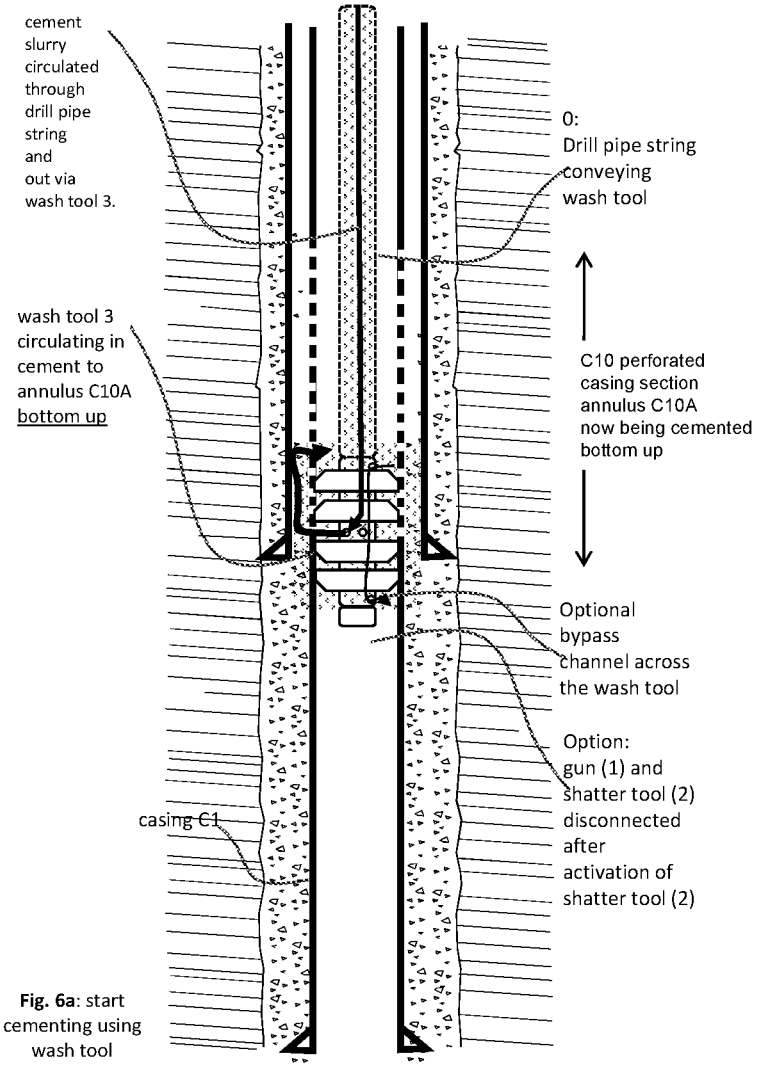
Fig. 6a: start cementing using wash tool cementing
bottoms up

Figure 6B:
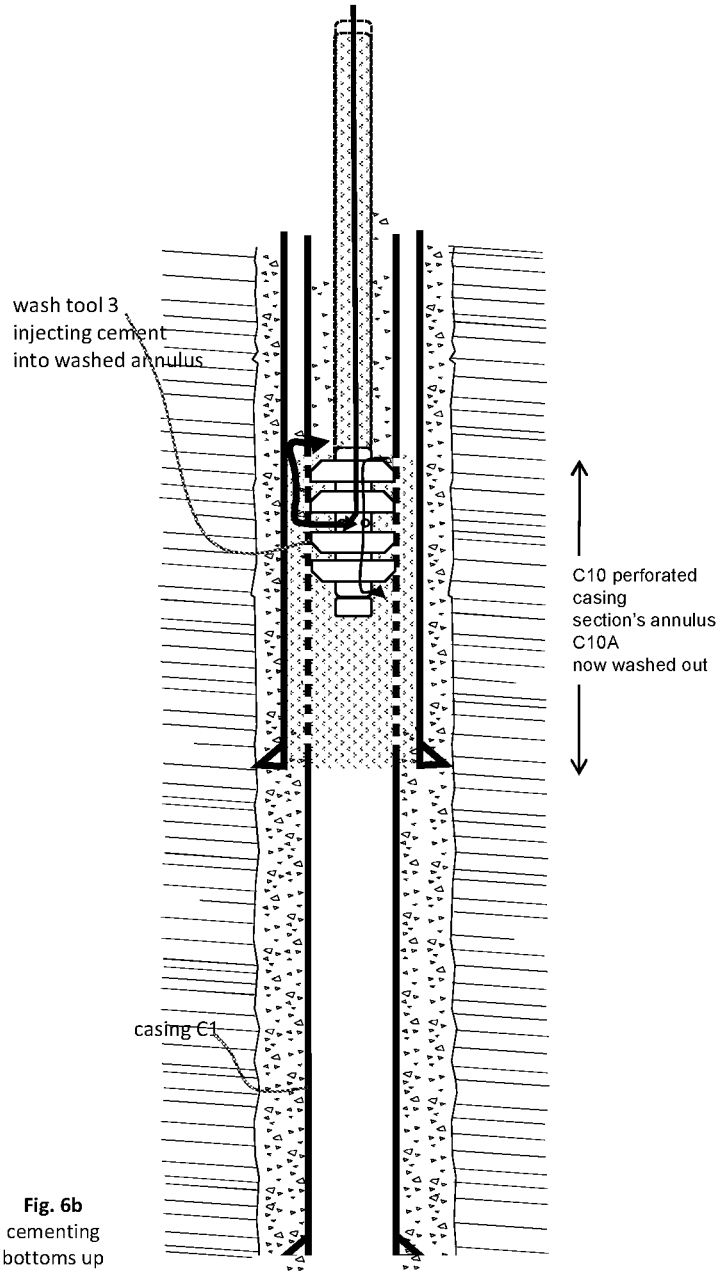

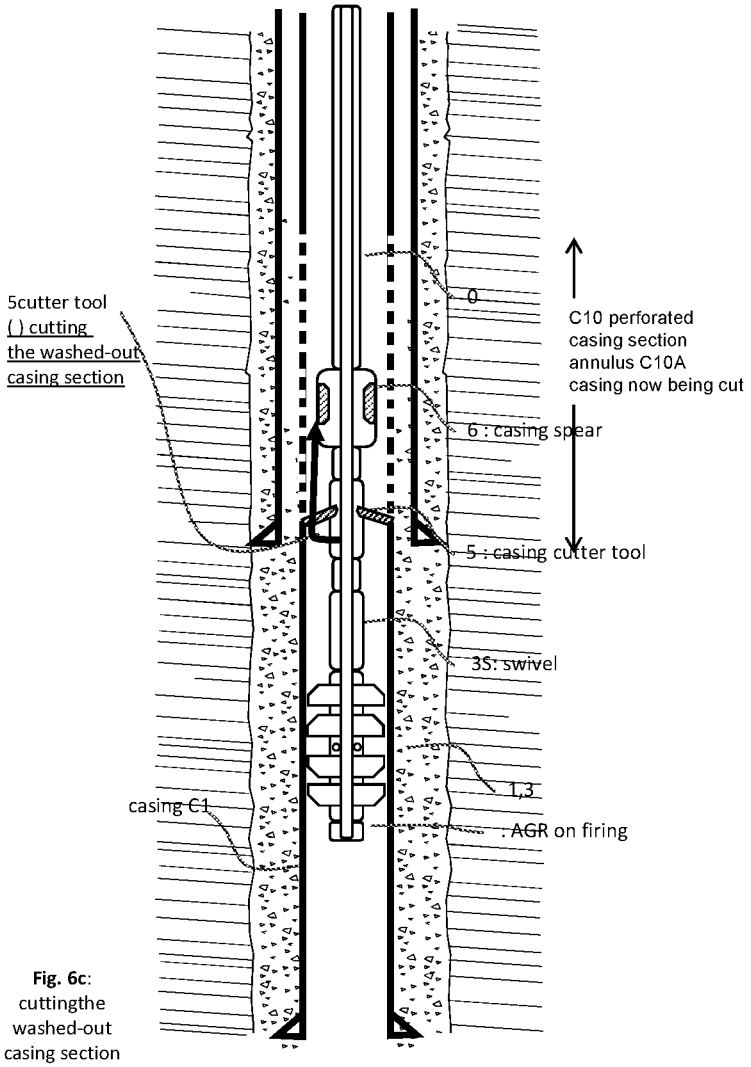
Fig. 6c: cuttingthe washed-out casing section subsequent to Fig. 5 or fig. 6b

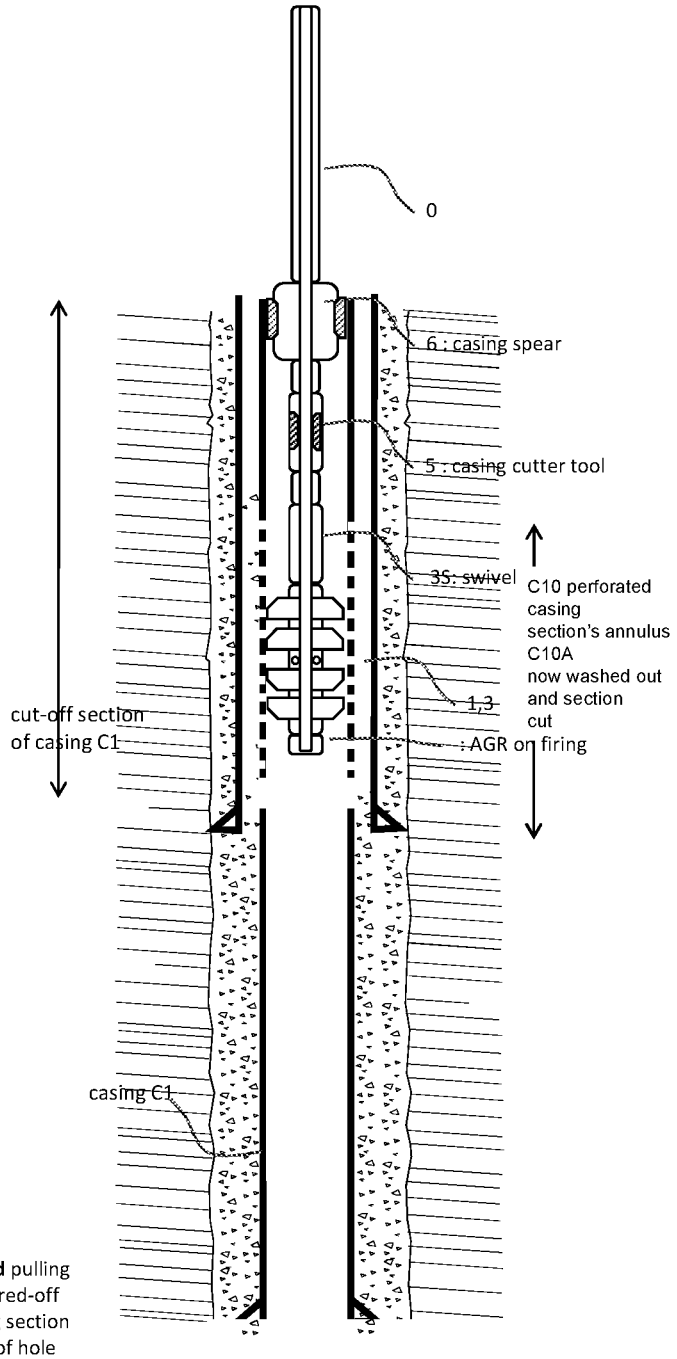
Fig. 6d pulling severed-off casing section out of hole

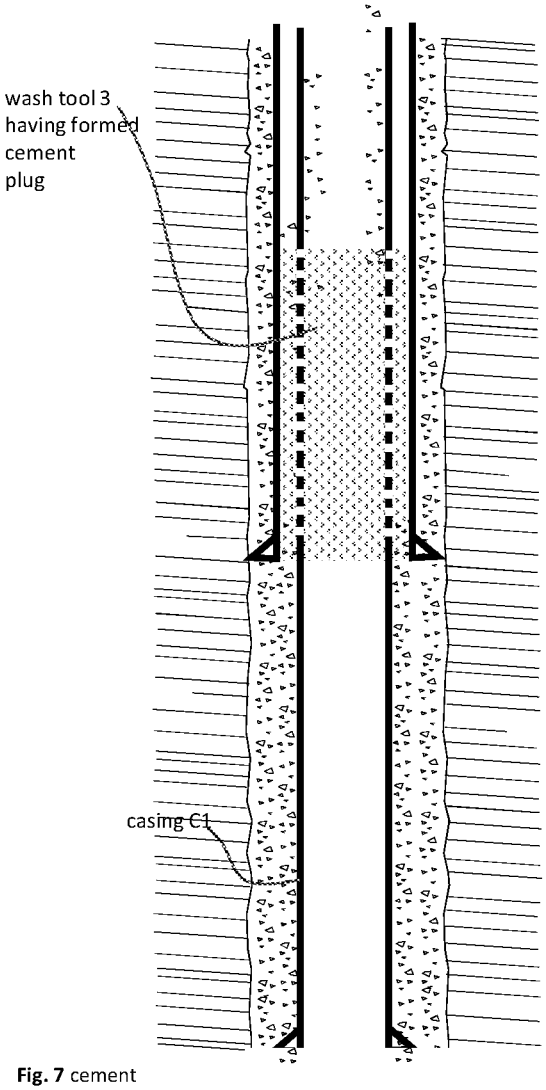
Fig. 7 cement plug formed

Fig. 8a
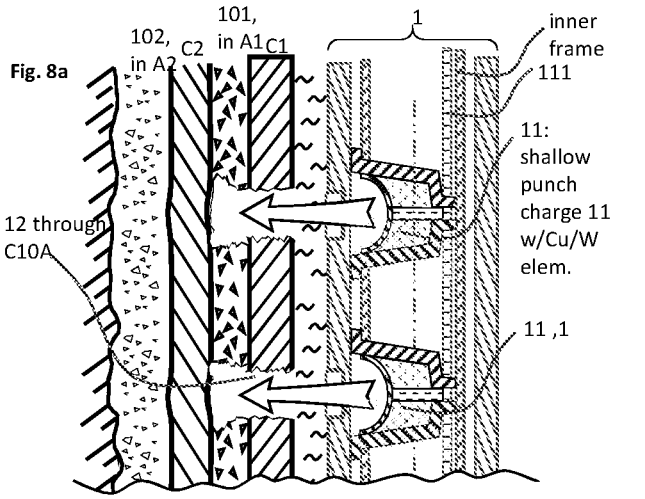
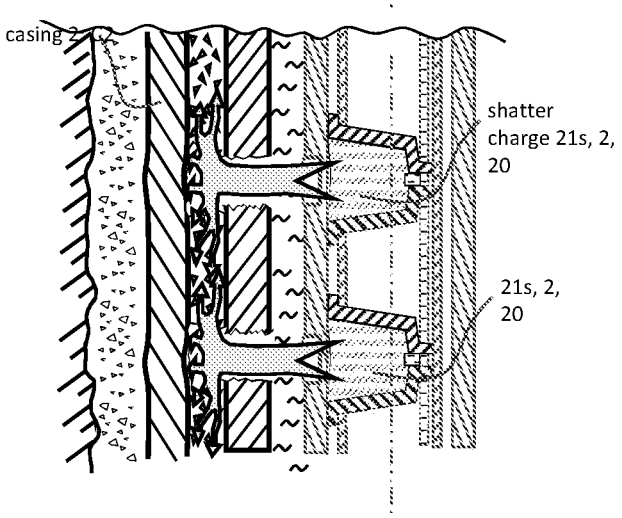
Fig. 8b

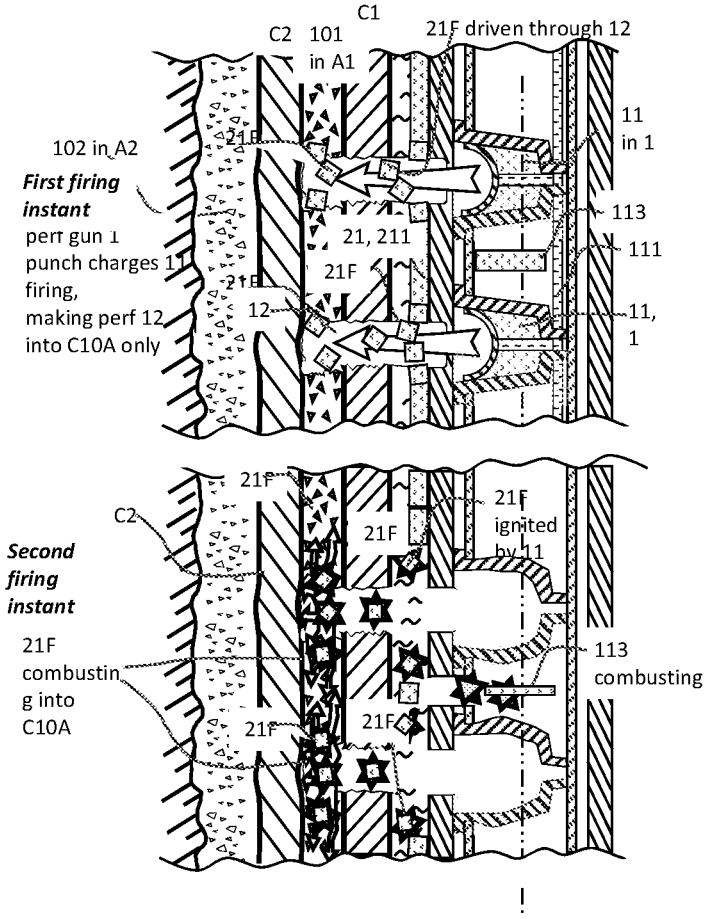
Fig. 8c combined tool (1, 2) with slow-burning charges 21 ignited by perforation charges 20. Upper part: firing of perforation charges 20, and lower part: same tool section after perforation charges set off; later stage wherein the slow-burning charges 21F spread, ignite, and combust.

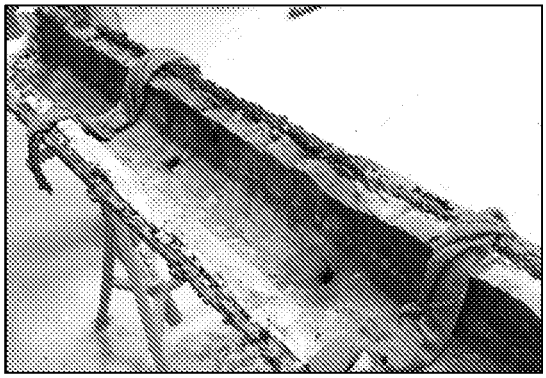

Fig. 9: A laboratory test of a dual casing perforated using a conventional circulation gun (shooting holes through inner casing (C1), cement (101), second casing (C2). The inner casing (C1) has been removed from the shot assembly and it is seen that the first annulus cement (101) is intact between the holes.

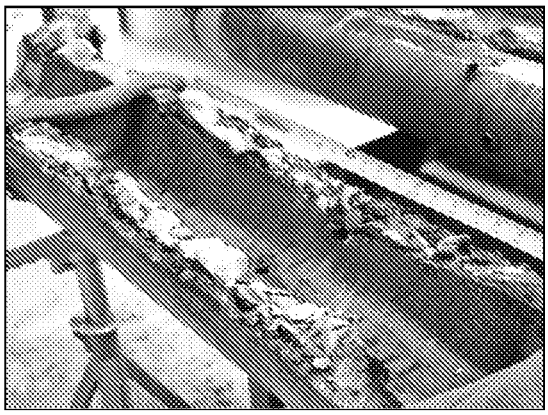

Fig. 10: Dual casing perforated and treated according to the present invention: Shallow perforations through inner casing (C1), and shot using second, slow-burning, energy rich charges which have broken up the first cement (101) between the perforation holes. We see that the cement is broken up and easily disintegrates.

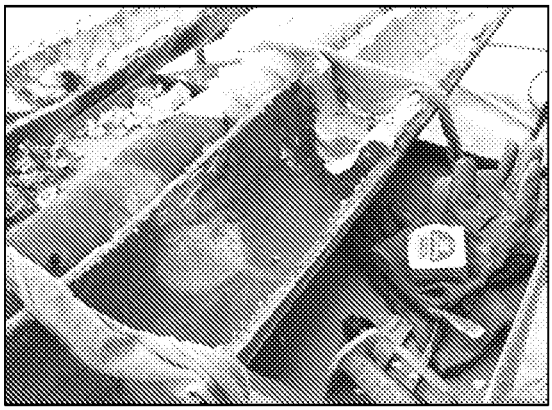

Fig. 11: Having removed the inner casing (C1) (for demonstrating the effect) from the annulus cement (101) broken up according to the invention: The cement is easily plucked away. This shows that a wash tool in the casing (1) may easily wash out the broken up cement (101) in the annulus (C10A)

TOOLSTRING AND METHOD FOR INNER CASING PERFORATING, SHATTERING ANNULUS CEMENT, AND WASHING THE FIRST ANNULUS IN A SECOND CASING

FIELD OF THE INVENTION

The present invention relates to the technical field of well intervention, wherein an inner casing is perforated without damaging a surrounding casing; an annulus cement about the perforated inner casing is disintegrated and washed out. According to the invention the perforated, annulus-washed-out casing is cut and pulled out of hole, or the perforated, washed-out casing bore and annulus is cemented for sealing the second casing, first annulus. In an embodiment a combination of plug cementing and cutting and pulling the perforated washed-out inner casing is done. The cutting and pulling of the inner casing frees up space in the second casing above the cut. The annulus cementing may serve several purposes such as for temporary or permanent plugging and abandonment.

BACKGROUND ART

Inner casings which are annulus cemented in second casings are usually cut in short sections and pulled section by section because they are very hard to pull if the cement is intact. If perforating the inner casing in order to wash out the annulus, there is a considerable risk of damaging the second casing.

Background art such as US2003/0037692 Liu fires charges indiscriminately through the casing, through cement, and far into the surrounding geological formation and injects aluminium powder to burn out the deep rock perforations, and to react with water in the formation to further combust. US2007/0095529 Bond describes shaped charges that forces oxygen-rich material into deep rock perforations to combust with oil in the geological formations.

Petroleum wells are lined with casing pipes extending from the surface, and liner pipes extending along parts of the well such as from a casing pipe's lower end. Several casings may be arranged with decreasing diameter within previously installed casing pipes along with the sinking of a well into the ground. A casing may be cemented to the surrounding borehole wall along critical points along the casing, such as in the upper portion, in the lower portion, and selected points along its length. A subsequent casing or liner may be cemented to the surrounding casing (or to the borehole wall) also at critical points in order to avoid leakage, or to stabilize the casing, or to isolate oil or gas producing zones, or to isolate from water-bearing zones. The cement in the casing annulus, whether in the first or subsequent annuli, is designed to be leak-proof and to have excellent bonding to steel and/or the surrounding geological formation.

In this context, not only cement may hold the first casing in place in the second casing; "cement" we may interpret as a material which does not disintegrate or dissolve by liquid flow alone, and may comprise homogeneous cement; partly cracked cement; baryte, salt based deposits, calcium carbonate based deposits and the like; scaling; and hard packed particulate matter in the annulus.

It may be required to use cement slurry to plug the first annulus over a given section of the casing for several different reasons. It may be done in order for sealing between influx zones, or for sealing a leakage in the annulus along the casing, or for forming a firm basis for drilling through the casing wall for drilling a deviated branch of the well, or for temporary or permanent plugging of the well, wherein the central bore of the casing is also plugged with cement. The remaining casing above may then be cut-off and removed. The annulus about a casing to be cemented may already comprise a cement fill which may be imperfect, or simply too short. Official regulations for plugging and abandonment of a zone of a well may require 50 m of plug, while an existing plug in the annulus may have shorter extension and thus not be acceptable for the P&A purpose. Such an annulus plug will then pose an obstacle to cementing the annulus over a desired, required new length, and should thus be removed in order to circulate in new cement slurry to form a new annulus barrier. In some such operations it may be important not to conduct the plugging of the first annulus without damaging the second casing as it may be properly sealed in what is then the second annulus. It is possible to conduct a milling operation in order to remove cemented casing. A method of cementing the annulus is to perforate the casing, wash the casing annulus with a drill pipe string conveyed washing tool with swab cups, and cement the annulus via a stinger in the casing bore and allowing the cement to enter the annulus via the perforations, such as in the textbook Nelson et al.: "Well cementing" second edition, p. 529, Schlumberger, 2006. However, if only the first casing shall be perforated to gain access to the first annulus, the perforation operation must be very carefully designed in order not do damage the second casing, so the cement in the first annulus is only locally perforated. After the perforation has been conducted, significant portions of the annulus may remain with intact annulus cement, and the casing annulus may not be washed. Shooting the first casing so intensively that it shatters the cement may solve the problem of gaining access to wash the annulus, but it will incur damage also to the second casing, which is not desirable in the present context.

NO20111641 describes a method similar to the above, wherein a casing is perforated using a perforation gun, the annulus washed out using a drill pipe string washing tool with swab cups which is left behind as a basis for the subsequent cementing, and cement is introduced via at least the drill pipe string in the central bore of the perforated, washed-out casing. According to NO20111641 cement may then enter the washed-out annulus for allowing to set.

NO20131131 Bakken describes a method of perforating a casing, washing out the annulus of which the perforations give access using a swab cup wash tool, and cementing the annulus by circulating in cement via the drill pipe string and the wash tool, preferably starting cementing at the bottom and utilizing by-pass lines within the wash tool to allow cement to fill the casing below the wash tool as it is being slowly pulled upwardly while pumping in cement to the annulus.

U.S. Pat. No. 5,775,426 Snider et al., describes an apparatus and method for perforating and stimulating a subterranean formation. The apparatus comprises one or more explosive charges, a shell of propellant, the explosive charges being positioned within the shell of propellant; and a detonator ballistically connected to the one or more charges. The shell may be a cylindrical sleeve. The shell may be provided with at least one groove or channel in order to assist in uniformly breaking up. The propellant material may thus disintegrate or decompose upon detonation of the one or more charges. The propellant may be water repellant or water proof, and will not be affected physically by hydrostatic pressures in the well, and it may be non-reactive to well fluids. The purpose of Snider is that the propellant material generate gases which clean the perforations formed in the formation by detonation of the shaped charges and which extend fluid communication between the formation and the well bore. In the present context, making a fluid communication between the geological formation and the central casing bore would counteract the purpose of sealing the first annulus with cement, as the deep perforation could incur new communication paths around the cemented annulus.

US patent U.S. Pat. No. 4,253,523 to Ibsen describes a primary explosive arranged in directional charges of long reach distributed along the cylindrical main body of a perforation gun. A secondary explosive with slower detonation properties than the primary charges is placed between the directional primary explosives. Such a slower detonating secondary explosive produces a prolonged blast and a desired fracturing of the formation around perforations made by the primary explosive charges. The secondary explosive may be activated ammonium nitrate. A main purpose of Ibsen is to make deep perforations into the geological formation.)

US patent U.S. Pat. No. 7,913,761 to Pratt describes a method for perforating a subterranean formation including positioning a shaped charge and a reactant composite material in a carrier; positioning the carrier in the wellbore; detonating the shaped charge; and disintegrating the reactant composite material using a shock generated by the detonated shaped charge. The reactant composite material may be configured to disintegrate upon detonation of the shaped charge.

All of Snider, Ibsen, and Pratt devise methods for perforating rather deeply, making deep perforations into the surrounding geological formation for enhancing the fluid access from the surrounding geological formation to the wellbore, thus stimulating production. A second casing surrounding the inner casing would be perforated, too, using the prior art. The present invention is for punching perforations limited to the inner, first casing, breaking up or disintegrating cement within the first annulus, washing out the broken up or disintegrated cement thus removing the cement in the annulus in order to gain access for new, continuous sealing cement for plugging the first annulus.

(0013) US2020115981A1 describes a tool for fracturing at least one tubular. The tool comprises a plurality of parallel columns of explosives and a detonation system configured to detonate the columns of explosives. The columns are arranged such that upon detonation, at least a portion of the Shockwave propagating in a direction outwardly from the tool from one column combines with at least a portion of the Shockwave propagating in a direction outwardly from the tool from another column to create a combined Shockwave of greater intensity than either of the Shockwaves which formed the combined Shockwave.

WO2020256563A1 relates to a casing retrieval drill pipe string conveyed toolstring assembly for a well comprising one or more casings. Said toolstring assembly comprising: —a casing spear tool arranged for engaging an inner wall of said casing and lifting part of said casing out when severed; —a casing cutter tool arranged for cutting and severing said casing at a casing cutting target depth—a casing perforation punching tool arranged for perforating said casing—wash tool arranged for washing said casing's annulus through perforations made by said punching tool.

US2020165896A1 describes a system for forming an upper plug in a well. The system, comprising lower tool segment that is adapted to land within a wellhead housing under open water conditions, a well control package that is adapted to be positioned above the lower segment and coupled to the wellhead housing, the well control package comprising at least one seal ram, an upper tool segment that is adapted to be positioned through the well control package (i.e., after the well control package has been attached to the wellhead) and operatively coupled to the lower tool segment, wherein at least one seal ram of the well control package is adapted to engage an outer surface of the upper tool segment, and at least one cutting means that is coupled to the lower segment and adapted to be actuated to cut at least one opening in at least one section of casing within the well.

WO2012105852A1 discloses a tool for the handling of wells through a formation, and which shall be taken out of operation with a device for a closing plug of a material that can be hardened, such as concrete, where there is a casing pipe in the well that is cemented against the wall in the bore hole with concrete. The tool comprises an assembled unit from the following three sections; a perforating lance comprising a number of explosive charges to form by detonation a row of holes in the pipe and out into the surrounding layer of concrete, a cleaning unit for mechanical cleaning of the inner wall of the pipe in the perforated area and a flushing unit to loosen, dissolve and flush away the hardened cement material between the outer wall of the pipe and the wall of the bore hole. Also described is a method to plug a well that shall be taken out of operation.

WO2020208327A1 discloses an apparatus for cleaning the area around a casing of a wellbore. The apparatus comprises a body configured to be located in a wellbore casing, the body defining an internal chamber for receipt of pressurised fluid. Pistons are mounted in the body and is arranged to move from an inwardly retracted condition to an outwardly deployed condition as a result of an increase in fluid pressure in the internal chamber. Pistons further comprise at least one first nozzle arranged to direct a jet of pressurised fluid from the apparatus.

BIZLEY, D. Subsea P&A. Upstream, Energy Global. 2015.05.07 (as published on the internet 2018.04.24) describes a system and a method for plug and abandonment (P&A) of wells. The method comprises the steps of:

- Step 1: Well has been TA'd, tubing has been cut and pulled, and a cast-iron bridge plug and packer have been installed.
- Step 2: The upper assembly—consisting of an isolation bushing, tubing-conveyed perforating guns, and a telescoping joint—are landed and latched into the packer.
- Step 3: The upper tubing is conveyed and the lower standard perforating guns are fired into the B annulus.
- Step 4: Circulation is established through the tubing, into the lower perforations, up the B annulus, out through the upper perforations, and back up the production annulus. The isolation bushing diverts flow to the return lines.
- Step 5: The binary plug is circulated into the B annulus. After waiting on the cement to harden, a mandatory pressure test is performed.
- Step 6: The upper tubing is conveyed, and the lower standard perforating guns are fired into the C annulus.
- Step 7: Circulation is established through the C annulus as with the B annulus before.
- Step 8: The binary plug is circulated into the C annulus. The plug is left in a 'balanced' condition with the production annulus. After waiting on the cement, testing is performed.
- Step 9: The upper assembly is unlatched from the packer and pulled from the well. A cast-iron bridge plug is set above the highest perforations and cement is bailed as per regulations. Wild Well advises customers to leave the well head intact.

Short Summary of the Invention

A main object of the present invention is to disclose a device and a method for removing the old, hardened cement in a casing annulus in order to conduct a cut and pull operation of the inner casing, or a proper sealing cementing operation in the annulus and possibly also in the central bore, or a combination of the two, with plugging below the cut and pulling the cut-off casing, all using the same toolstring. The cement previously present in the annulus to be removed before the perforated, shattered, washed-out annulus is sealed by new cement may cover part of or the entire section which shall be sealed.

In one aspect, the invention is a method of annulus cleaning an annulus-cemented (102) casing portion (C10) of a first casing (C1) in a second casing (C2) in a petroleum well, comprising the steps of:

running a drill pipe string (0)—conveyed perforating gun (1) with a cement shattering device (2) into said well;

positioning said perforating gun (1) at said cemented casing portion (C10) and activating first, shallow-perforating charges (11) to make first, shallow perforations (12) through said casing portion (C10) intoa cement-filled annulus portion (C10A) and leaving said second casing (C2) intact;

activating said cement shattering device (2, 20) to disintegrate all or part of said cement (102) within said first perforated annulus portion (C10A);

running a washing tool (3) along said perforated casing portion (C10), washing out all or part of said shattered cement (102) from said perforated annulus portion (C10A).

In an embodiment of the invention we use the cutter tool (5) to cut-off a section of the annulus-washed casing section (C1), and pull the severed—off casing section out of hole using a casing spear (6).

In an embodiment of the invention, after the washing step, running a cementing tool (7) and circulating in cement slurry (c) into at least said washed-out annulus (C10A) around said perforated casing portion (C10) of said well for sealing said annulus (C10A). This may be conducted ahead of the cutting and pulling step above, or instead of them.

Further dependent steps are indicated in the attached set of claims.

In another aspect, the invention also is a casing annulus cleaning tool string comprising a drill pipe string (0) with a conveyed perforation gun (1) and a cement shattering device (2)

arranged near said drill pipe string's (0) lower end, for being lowered into a casing (C1) with an annulus cemented (102) casing portion (C10) about said casing (C1) in a petroleum well, said perforating gun (1) arranged with first, shallow-perforating charges (11) for shooting first, shallow perforations (12) through said casing portion (C10) into a first annulus (C10A), said shallow-perforating charges (11) arranged for leaving a surrounding second casing (C2) intact;

said shattering device (2, 20) arranged for being activated after said shallow-perforating charges (11) to provide combustion energy through said shallow perforations (12) to disintegrate all or part of said cement (102) within said first perforated annulus (C10A);

a washing tool (3) arranged above said perforation gun (1) and cement shattering device (2) on said drill pipe string (0), said washing tool (3) for washing out said shattered cement (102) from said annulus (C10A).

In an embodiment of the invention the toolstring comprises a casing cutter tool (5) and a casing spear (6).

In an embodiment of the invention said washing tool (3) is also arranged for circulating in cement slurry into said washed-out annulus (C10A) for sealing said annulus (C10A).

Further features of the invention are given in the dependent claims. It is highly advantageous to have the washing tool (3) arranged together with the perforation gun (1) and the cement shattering device (2) on the same drill pipe string, but strictly, they may be arranged as two separate tools run sequentially; the first tool comprising the perforation gun (1) and the cement shattering device (2) run on one string, and the washing tool (3) run on another drill pipe string, but running all tools on the same string is highly advantageous due to the time saved on the intervention rig. Further; it is advantageous running the cementing on the same run as the washing-out of the annulus because then there is less time for material to settle and lock in the first casing in the annulus. Further advantageous is to have also a swivel, a casing cutter tool (5) and a casing spear (6) integrated in the toolstring in order to conduct all operations in one run, or in two runs if it is desirable to remove the wash tool and casing cutter tool from the toostring before using the spear. The spear is still useful if swivelled and applied during the cutting operation, so it may be integrated in the toolstring from the beginning. Please see FIG. 6*c*, FIG. 6*d*, and FIG. 12.

FIGURE CAPTIONS

The attached figures illustrate some embodiments of the claimed invention.

Figure 1:
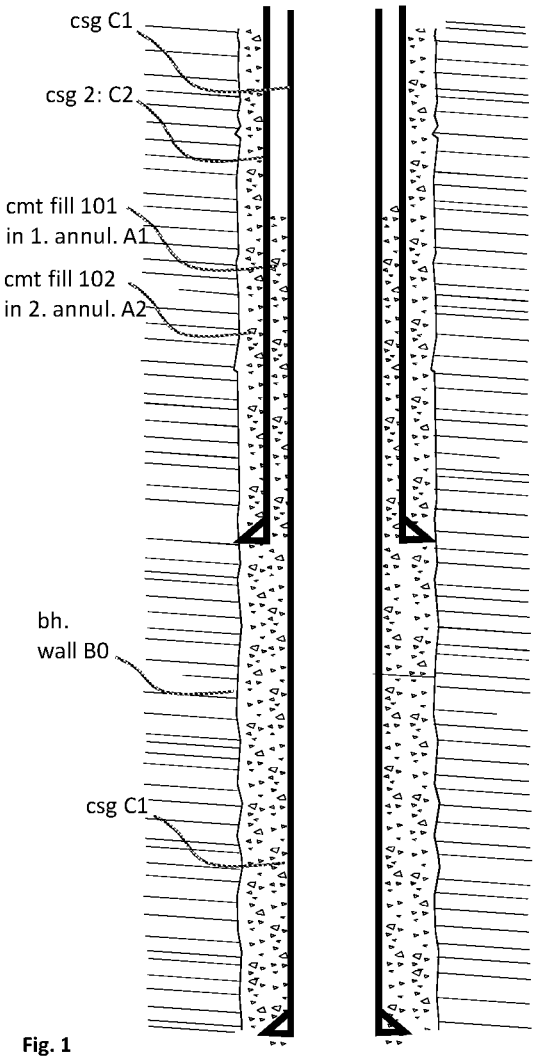

FIG. 1 illustrates a well with a first and a second casing (C1, C2), wherein the first casing (C1) is cemented (101) or otherwise fixed in part of or all of the first annulus (A1) along a part (C10A) outside a casing portion (C10) of the first casing's (C1) extent. The first casing (C1) is surrounded along part or all of its length by said second casing (C2). The casing (C1) annulus (C10A) shall according to the invention be cleaned out of the previous partial or complete cement and sealed with new cement, without damaging the second casing or its surrounding second annulus cement.

Figure 2A:
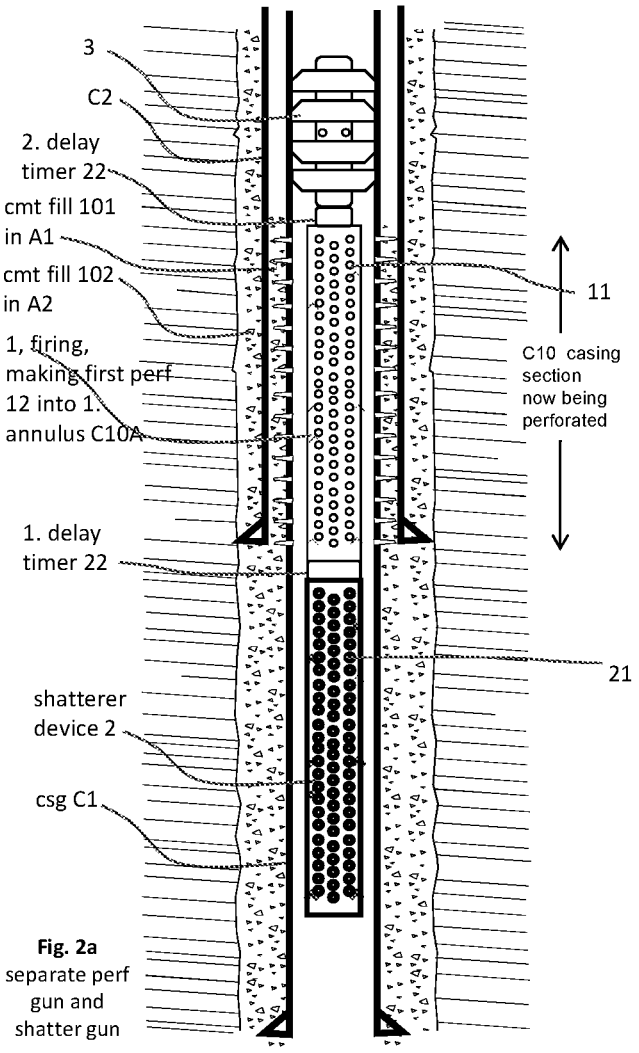

FIG. 2*a* is an illustration of the perforation gun (1) firing through a desired section; casing portion (C10) of the first casing (C1), while leaving the second casing (C2) generally intact.

FIG. 2*a* further shows:

Perforation gun (1) firing making first perforations (12) into first annulus (C10A)

Separate perf. gun and shatter gun

Casing section (C10) now being perforated

Figure 2B:
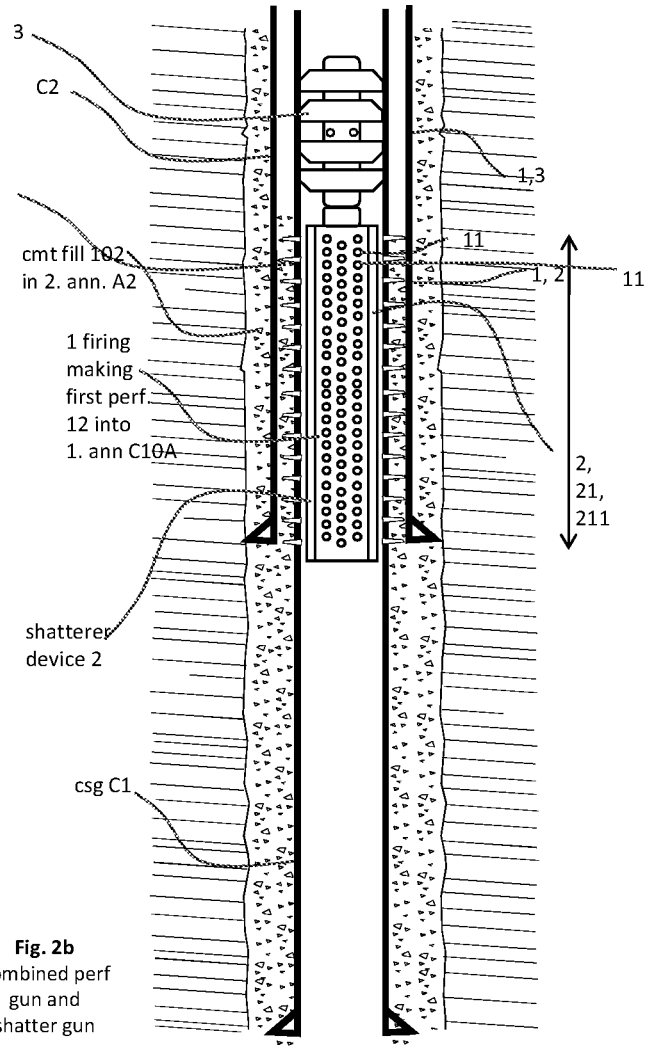

FIG. 2*b* is an illustration of an embodiment of the invention wherein the perforation gun (1) is combined with a shattering tool (2); the perforation gun (1) fires and makes perforations (12) through the wall of the first casing (C1) making a perforated casing portion (C10). In the embodiment illustrated it fires through the shattering tool (2) portion of the combined tool, a cylindrical sleeve (211), and brings along second charge fragments (21F) from the cylindrical sleeve (211) through the perforations (12).

Further FIG. 2*b* shows:

C10 casing section now being perforated

Perforation gun (1) making first perforations (12) into first annulus

Combined perf gun and shatter gun

Figure 3A:
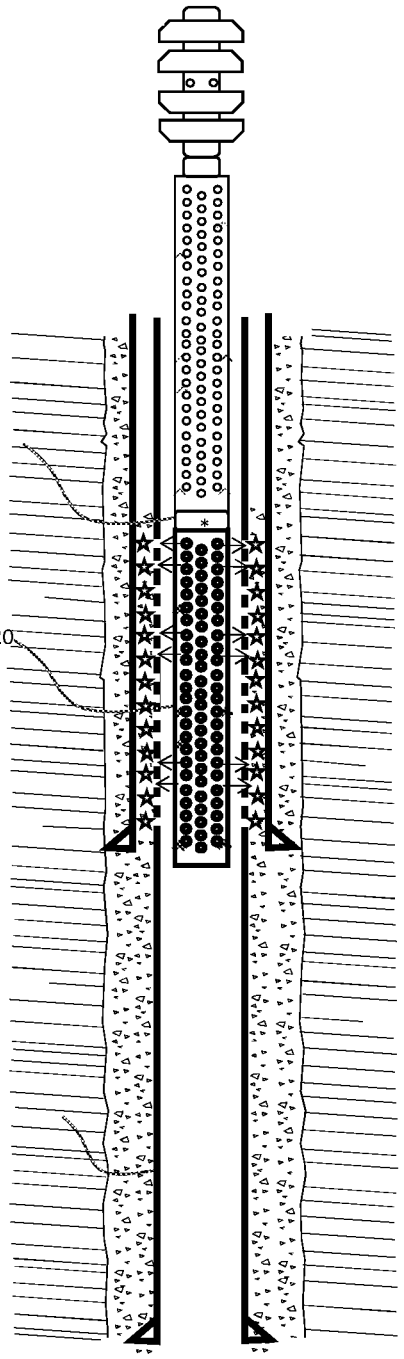

FIG. 3*a* is an illustration of a shatterer device (2), in the embodiment of a second gun (20), has been pulled upwardly to the perforated casing section (C10). The second gun (20) is triggered. This incurs shattering of the first annulus' (C10A) cement (101), and partially releases the cement from the inner and outer casings (C1, C2). Please also see FIG. 10.

Further FIG. 3*a* shows:

shatter gun displaced and given delayed activation

Figure 3B:
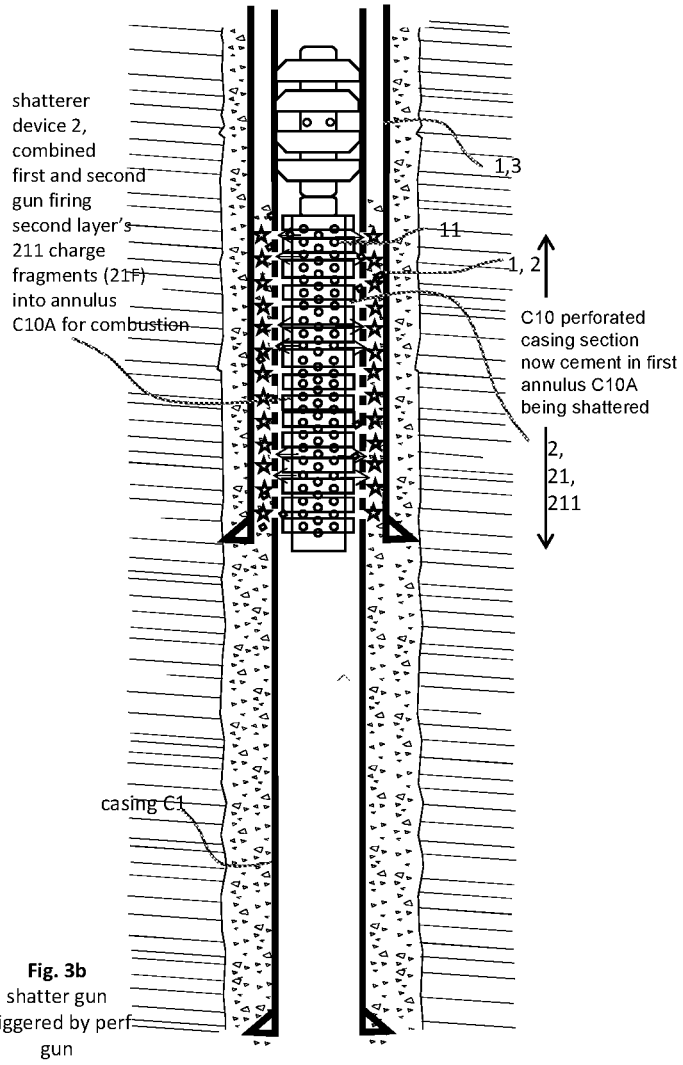

C10 perforated casing section now cemented in first annulus (C10A) now being shattered FIG. 3*b* is an illustration of a shatterer device (2) in the embodiment of a combined perforation gun (2) with a second charge (211) being ignited by the perforation charges and creates charge fragments (21F) which generate heat in the first annulus (C10A) and within the casing. Please also see FIG. 13.

Further FIG. 3*b* shows

Shatter gun triggered by perforation gun

Shatter device (2), combined first and second gun firing second layers (211) charge fragments (21F) into annulus (C10A) for combustion C10 perforated casing section now cemented in first annulus (C10A) now being shattered FIG. 4 illustrates the tool string with the washing tool (3) run further into the casing so as for aligning the wash tool (3) with the perforated, annulus cement shattered casing section (C10). The wash tool (3) is aligned with the upper portion of the perforated casing section (10), and washes out the annulus (C10A) while being moved downwardly towards the bottom of the perforated casing section. This effectively removes shattered cement debris from the annulus (C10A) and thus prepares the annulus for being cemented. Before the washing step shown in FIG. 4, the perforation and/or shattering tool (1, 2) tool may be disconnected from the washing tool (3) using an ordinary ball-release sub below the washing tool (3) and the perforation tool (1). This is advantageous both due to operational safety, personal safety, and operation of ease.

Further FIG. 4 shows:

Washing downwardly

C10 perforated casing section's annulus (C10A) now being washed out

FIG. 5 illustrates the resulting washed-out annulus (C10A) along the perforated casing section (C10).

Further FIG. 5 shows

Washing downwardly finishing

Wash fluid normal—circulated through drill pipe string and out via wash tool (3)

wash tool (3) normal—circulating and washing annulus C10A top down with wash fluid C10 perforated casing section annulus (C10A) now being washed top down FIG. 6*a* shows the generally washed-out casing section (C10) annulus engaged the swab cups of the wash tool (3) near the lower perforations, while cement slurry is being pumped down via the conveying drill pipe string, out between the swab cups, and circulated without excessive force out into the washed-out, preferably spacer fluid primed annulus (C10A) lower portion. Excess cement re-entering above the wash tool may be by-passed down through a bypass channel in the wash tool in order to allow moving the wash tool upwardly while cementing.

FIG. 6*a* further shows:

Start cementing using wash tool

Cement slurry circulated through drill pipe string and out via wash tool (3)

Wash tool (3) circulating in cement to annulus (C10A) bottom up

C10 perforated casing section annulus C10A now being cemented bottom up

Option: gun (1) and shatter tool (2) disconnected after activation of shatter tool (2)

FIG. 6*b* illustrates the wash tool having cemented the entire annulus up to the upper portion of the washed-out, now cement slurry filled annulus (C10A). The illustrated length of perforated, washed-out, now cement slurry filled annulus (C10A) is far longer in reality than illustrated here and may be 50 metres or more in order to provide a regulatory required length of cement sealed annulus.

FIG. 6*b* further shows:

Cementing bottoms up

Wash tool (3) injecting cement into washed annulus

C10 perforated casing section's annulus now washed out

FIG. 6*c* illustrates an embodiment wherein after washing out the annulus (C10A), the casing cutter tool (5) is activated and rotates to cut off the casing (C1) without cutting the second casing (C2). The cut is made in the washed-free casing section (C10) which should now be free of cement in the annulus (C10A). The cut may be made after the step of FIG. 6*b* wherein a cement plug is formed across part of the washed-out annulus (C10A) below the cut to be made, or conducted without any cement plug.

FIG. 6*c* further shows:

Cutting the washed-out casing section subsequent to FIG. 5 or FIG. 6*b*

Cutter tool (5) cutting the washed-out casing section

C10 perforated casing section annulus C10A casing now being cut

FIG. 6*d* illustrates the further step after the cut is made in FIG. 6*c*, wherein the casing spear (6) has been moved to an upper portion of the cut-off section of casing (C1), and pulled out of hole.

FIG. 6*d* further shows:

Pulling severed-off casing section out of hole

C10 perforated casing section's annulus (C10A) now washed out and section cut FIG. 7 illustrates the resulting plug sealing the annulus and the casing bore. If required for plugging wall-to-wall within the second casing, the cement slurry also in the casing bore may allow to settle and harden so as for plugging and abandoning the well below the plug. If required for sealing only the annulus, the cement slurry in the casing bore may be circulated out of the casing bore, (usually with reverse circulating).

FIG. 7 further shows:

Cement plug formed

Wash tool (3) having formed cement plug

FIG. 8 is, in the upper half, FIG. 8*a*, an illustration of a cross section of the first perforation gun (1) perforating shallowly and only through the first casing (C1), leaving the second casing (C2) generally intact. In the lower half, please see FIG. 8*b*, is illustrated the same position along the well, the same part of the perforated section (C10) wherein is fired the higher-energy slow-burning charges (21) of the shatterer device (2), the second gun (20). The result is illustrated in FIG. 10 below.

FIG. 8*c* illustrates the same vertical sections of the same perforation gun (1) and shatterer device (2) with very short delay. The upper part illustrates an embodiment of the perforation gun (1) combined with a shatterer device (2) constituting one combined perforation and shatterer tool (1, 2), wherein the perforation gun fires shallow perforations (12) through the first casing (C1), and carries fragments (21F) of a second charge (21) through the perforations (12) and into the first annulus (A1). In the lower part is illustrated the same tool section a few milliseconds later, the situation after the perforation charges have set off, wherein the slower-burning charges 21F have spread, and ignite and combust.

FIG. 8*c* further shows:

Combined tool (1, 2) with slow-burning charges (21) ignited by perforation charges (20). Upper part: firing of perforation charges (20), and lower part: same tool section after perforation charges set off; later stage wherein the slow-burning charges (21F) spread, ignite, and combust.

FIG. 9 is a photographic image of an ordinarily perforated dual casing with cement (101) inbetween, the inner casing removed after perforation and splitting away of half of the dual casing.

FIG. 9 further shows:

A laboratory test of a dual casing perforated using a conventional circulation gun (shooting holes through inner casing (C1), cement (101), second casing (C2). The inner casing (C1) has been removed from the shot assembly and it is seen that the first annulus cement (101) is intact between the holes.

FIG. 10 is a photographic image of a perforated and shattered cement according to the invention.

FIG. 10 further shows:

Dual casing perforated and treated according to the present invention: Shallow perforations through inner casing (C1), and shot using second, slow-burning, energy rich charges which have broken up the first cement (101) between the perforation holes. We see that the cement is broken up and easily disintegrates.

FIG. 11 is also a photographic image corresponding to FIG. 10, with the shattered cement picked away and removed from the annulus within the second casing.

FIG. 11 further shows:

Having removed the inner casing (C1) (for demonstrating the effect) from the annulus cement (101) broken up according to the invention: The cement is easily plucked away. This shows that a wash tool in the casing (1) may easily wash out the broken up cement (101) in the annulus (C10A)

Figure 12:
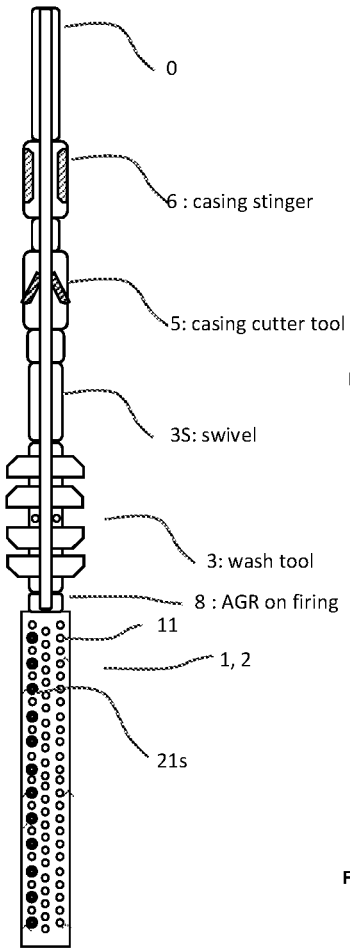

FIG. 12 illustrates an embodiment of the invention wherein the perforation gun and the shattering gun are combined in one common gun tool (1, 2), and further combined with a wash tool above, and a drill pipe string (0). Also shown is the embodiment wherein there is further included a swivel (3S), a casing cutter tool (5), and a casing stinger (6).

Figure 13:
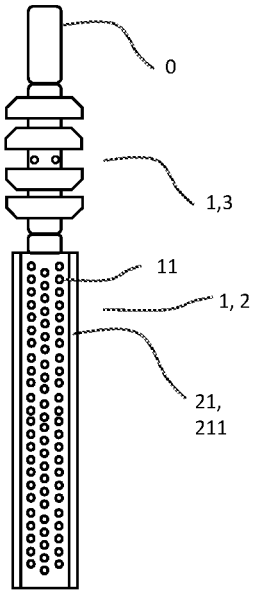

FIG. 13 shows an embodiment of the invention also illustrated with details in FIG. 8*c*, and which is also illustrated in use in FIG. 3*b*. In this embodiment, said shatter tool's (2) slow-burning higher-energy charges (21) is arranged as a sleeve-shaped layer outside on and in combination with said perforation gun's (1) shallow-penetrating charges (11). In an embodiment a wash tool (3) is combined with this combined perforation and shatter tool (1, 2) and the entire tool is arranged for being run on a drill pipe string (0).

EMBODIMENTS OF THE INVENTION

The invention will in the following be described and embodiments of the invention will be explained with reference to the accompanying drawings.

The invention is a method of cleaning an annulus—cemented (102) casing portion (C10) of a first casing (C1) in a second casing (C2) in a petroleum well, comprising the steps of:

running a drill pipe string (0)—conveyed perforating gun (1) with a annulus cement shattering device (2) into said well;

positioning said perforating gun (1) at said cemented casing portion (C10) and activating first, shallow-perforating charges (11) to make first, shallow perforations (12) through said casing portion (C10) into thus making a perforated, cement-filled annulus portion (C10A) and leaving said second casing (C2) intact;

activating said annulus cement shattering device (2, 20) to disintegrate all or part of said cement (102) within said first perforated annulus portion (C10A);

running a washing tool (3) along said perforated casing portion (C10), washing out said shattered cement (102) from said perforated annulus portion (C10A).

In an embodiment of the invention the method further comprises running a casing cutting tool (5) into a portion of said perforated, washed-out casing portion (C10A), and cutting said first casing (C1);

running a casing spear (6) to set and hold in preferably a top of said perforated, cut-off casing section (C1, C10A), and pulling said cut-off casing section (C1, C10A) out of said second casing (C2) and out of hole.

We may then achieve to remove the inner casing (C1) which was cement-stuck fixed in the second casing (C2), in case the inner casing shall be removed, or replaced with a new casing, or if a sidestep shall be conducted, also in case a cement plug shall be formed before pulling out the inner, previously stuck casing.

The present invention is highly advantageous over prior art which is not capable of perforating the inner casing only and shattering only the cement in the inner casing's annulus without damaging the second casing. Prior art such as US2003/0037692 Liu fires charges indiscriminately through the casing, through cement, and far into the surrounding geological formation and injects sluminium powder to burn out the deep rock perforations, and to react with water in the formation to further combust. US2007/0095529 Bond describes shaped charges that forces oxygen-rich material into deep rock perforations to combust with oil in the geological formations. The present invention provides a far gentler method of penetrating only the first, inner casing, and uses secondary igniting charges to slower-acting shattering of the annular cement material without damaging the second casing. Thereby, the first casing may be washed free from its annulus, and may be cut and pulled.

In a further embodiment of the invention the method comprises assembling said perforation gun (1) with said cement shattering device (2) first, then assembling the AGR (8) on said perforation gun (1), then assembling said wash tool (3) on said AGR (8);

then mounting a swivel (3S) which allows rotation of the toolstring above the wash tool, which should not be rotated due to the rubber cups;

then we mount a rotating cutter tool (5) on the swivel, and then said casing spear tool (6);

and then said drill pipe string (0) which is used for running into the well.

The casing spear tool (6) is advantageously in an embodiment arranged at the top of the toolstring BHA in order to have a good tensile strength margin throughout the DP string (0) and the casing spear tool (6) in order to pull out the casing. The washing tool (3), the swivel (3S), and the cutter tool (5) may in an embodiment of the invention be removed from the toolstring before engaging the casing stinger (6) in the top of the cut-off casing section to be pulled, in order to facilitate the tripping out. The AGR (8) has dropped the guns (2) after firing, anyway, we don't want misfired gun charges to the deck.

In an embodiment of the invention, we run a cementing tool (7) and circulate in cement slurry (c) into at least said washed-out annulus (C10A) around said perforated casing portion (C10) of said well for sealing said annulus (C10A). This is done before a cut and pull operation described above, or instead of a cut and pull operation if the purpose is just to cement the first annulus between the inner and second casing (C1, C2).

The annulus cement shattering device (2, 20) may in one embodiment be a tool arranged separate from and below the perforation tool (1), please see FIG. 2*a*, FIG. 3*a*, FIG. 4, FIG. 5, FIG. 8*a*, and FIG. 8*b*, and thus has to be displaced to the perforations (12) made by the perforating tool (1) before the annulus shattering device (2) is activated, such as defined in claims 2, 3, 4, and 5.

The annulus cement shattering device (2) may in another embodiment be a tool extending along the same portion along the stem of the perforation tool (1) itself. The annulus cement shattering device (2, 20) may thus be embodied together with the perforation tool (1) and used such as defined in claims 6, 7, 8, and 9, please see FIG. 2*b*, FIG. 3*b*, FIG. 8*c*, FIG. 12, and FIG. 13. In this case, the shattering tool (2) may have a brief delay of being activated after the firing of the perforation tool (1) in order to utilize the perforations (12) formed by the perforation tool (1), for "burning out" the perforations but also the annulus (C10A) outside the perforations.

The material in the annulus (C10A) be old, hardened cement, but not necessarily cement; it may also comprise compacted debris, clay, and other particles which seal the first casing annulus in the borehole or in a subsequent casing so that it may not easily be perforated, washed and pulled, or perforated, washed and sealed, either for replacement pulling, or plug and abandon, or for sealing an annulus leakage. Not all the annulus length (C10A) may necessarily comprise old cement or similar material preventing a good wash-out of the annulus, only part may be blocking. Anyway, the old cement must be shattered, disintegrated and washed out before freeing the casing for cutting and pulling, or new cement slurry is circulated in to form a proper seal of required length. The perforated and washed-out casing portion (C10) of the inner casing (C1) may comprise a non-perforated part of any length above the perforated section (C10).

The length of the perforation gun (1) may be 50 to 100 metres or more, assembled screwed together from gun sections of lengths 6½ m, 9 m, or other lengths. The length of the desired casing portion (C10) to be perforated depends on the length of the cemented annulus to be cut and pulled, or the length of the cemented annulus to be sealed properly, a length of 50 m or more, which may be more than previously existing zonal isolation lengths.

The length of the assembled shattering device (2) will most preferably be of the same length, particularly if it is assembled along the same stem length, as the assembled perforation gun itself. Having such extensive lengths of perforation gun and shattering device allows long lengths of casing to be perforated, shattered, washed-out, and cemented in one single trip.

FIG. 1 illustrates a well with a first and a second casing (C1, C2), wherein the first casing (C1) is cemented (101) with existing cement in the first annulus (A1) along a part (C10A) outside a casing portion (C10) of the first casing's (C1) extent. The purpose is to free the first casing (C1) from a second casing (C2) in order to pull it out of hole. Alternatively, the purpose is to cement the first casing portion (C10) of the casing (C1) and to leave the second casing (C2) and its second annulus cement (102) or other fill, if present, intact as far as practical to achieve. The second casing may be cemented (102) in what is called the second annulus (A2) to the borehole wall (B0) as illustrated, or to a third casing on the outside of the second casing. In the present method it is desirable not to affect the second annulus but leave the second casing (C2) and its annulus cement (102) intact, regardless of whether we pull the first casing (C1) or we plug the first casing (C1) and its annulus The inner casing may be a 9⅝" pipe having a wall thickness of 15 mm or more. The second, outer casing may be a 13⅜ pipe having a similar wall thickness. Other casing dimensions may of course apply. In any way, the first and second casings (C1, C2) constitute part of the context of the present invention.

FIG. 2*a* is an illustration of the perforation gun (1) firing through a desired section, a casing portion (C10) of the first casing (C1), while leaving the second casing (C2) intact with only minor scratches. Short-focus charges in the perforation gun (1) have the property of "punching" perforation holes through the first casing wall, and not through the second casing (C2) wall, which is left intact. But due to the perforations' relatively small charge and being geometrically focussed, only relatively narrow holes are made with short range, extending only into the concrete in the annulus (C10A); no major shattering of the first annulus cement (101) occurs. This is also visible from FIG. 10 wherein the inner casing from the split-up test setup has been removed for observing the cement status; the perforations punch a relatively small hole in the cement. So a major proportion of the so perforated casing section (C10) of the casing (C1) may remain fixed to the remaining, intact cement (101) and thus still be stuck to the cement (101) and to the second casing (C2), thus forming in a real well an obstacle to annulus washing of that part of the perforated casing.

In an embodiment of the invention, the cement shattering device (2) comprises a second gun (20) with delayed, slow-burning charges (21) detonating in part via said first perforations into said perforated casing portion's (C10) annulus (C10A). In an embodiment of the invention, the perforating gun (1) (above) and said cement shattering device (2) (below) are combined on the same drill pipe string (0), please se FIGS. 2*a* and 3*a*. FIG. 3*a* is an illustration of a shatterer device (2), in the embodiment of a second gun (20), having been pulled upwardly to the perforated casing section (C10). The length of the second gun (20) may be the same as the length of the first perforation gun (1). The second gun (20) may be triggered by a delay timer (22) initiated by the firing of the first perforation gun. The second gun (20) fires slower burning charges (21, 21*s*) (please see FIG. 3*a* and FIG. 8*b* which are also of higher energy than the first short-focus charges (11). It is not necessarily a perforation gun as such, as it fires/combusts and the fire gases are pressed into and through existing perforations. This incurs a shock wave and thermal energy which in combination results in shattering of the first annulus' (C10A) cement (101) and shatters and burns it out, and partially releases the cement from the inner and outer casings (C1, C2). Please also see the result in FIG. 10, wherein in FIG. 10 the inner casing (C1) (removed) of a dual casing is perforated and treated according to the present invention: Shallow perforations through inner casing (C1), and shattered using second, slow-burning, energy rich charges which have broken up the first cement (101) between the perforation holes. We observe that the cement is broken up and easily disintegrates.

So in an embodiment of the invention, after step (a) perforating using the first perforation gun (1) and forming first perforations at perforated casing section (C10); the following is conducted:

activating a delay timer trigger device (22), pulling outwardly to place said shattering device (2) within said perforated casing section (C10);

allowing said delay timer trigger device (22) to trigger said shattering device (2), shattering the annulus cement.

This procedure using the delay timer trigger device (22) allows a certain time to activate the second gun (2), a delay which allows the pulling up to relocate the second gun (2) to where the first perforation gun (1) was fired.

In an embodiment of the invention, the perforation gun (1) and the shattering device (2) are combined in the same section of the tool, please see FIG. 8*c*.

In an embodiment of the invention shown in FIG. 4, one may arrange the wash tool (3) above said first perforation gun (1). Further, in an embodiment of the invention, after having detonated said shattering device (2), one may conduct:

running into hole for said wash tool (3) to isolate upper perforations of said perforated casing section (10), normal circulating wash fluid through said perforations into said annulus (C10A), allowing return fluid from said annulus (C10A) through perforations above said wash tool (3), running downwardly while washing preferably the entire length of said perforated section's (C10) annulus (C10A), while circulating out cement and other debris within the first casing (C1). Please see FIGS. 4 and 5 below. An advantage of starting washing from the top of the perforated section (C10) is that one will only wash out debris from an upper part of the shattered annulus (C10A) cement debris initially, and may control the wash tool displacement speed downwardly according to how much cement debris is in suspension in the return flow at any time, a feature which is less controllable if one starts washing bottoms up of the shattered annulus, whereby one would run the risk of trying to lift too much debris at a time, risking blocking the wash tool from being pulled up in the casing.

FIG. 4 illustrates the tool string with the washing tool (3) run further into the casing so as for aligning the wash tool (3) with the perforated, annulus cement shattered casing section (C10). In a preferred embodiment of the invention the wash tool (3) is aligned with the upper portion of the perforated casing section (10), and washes out the annulus (C10A) while being run downwardly towards the bottom of the perforated casing section. This effectively removes shattered cement debris from the annulus (C10A) and thus clears the annulus (C10A) between the inner casing (C1) from the outer casing (C2).

FIG. 5 illustrates the resulting washed-out annulus (C10A) along the perforated casing section (C10). Here we have illustrated only a short cemented section; the perforating and shattering tools (1, 2) may have been used along a length of the casing section (C1) longer than the perforating and shattering tools (1, 2), which may have been fired multiple times with relocation of the tools for each firing, but the washing process using the wash tool may be done in one continuous sequence while pumping from the surface through the drill pipe string (and possibly through a casing stinger and vibrator).

Further, in an embodiment of the invention, the tool sequence may be as follows, please see FIG. 6: combining in sequence as illustrated in the attached drawings:

shattering tool (2) at the bottom of the string, said perforation gun (1) above it, or integrated with the shattering tool, the washing tool (3), preferably with bypass channels, above the perforation gun. The washing tool may be arranged with a through bore for supplying the wash tool with wash fluid, and with a ball passage for triggering the perforation gun (1), and requiring another ball diameter for closing the wash tool (3) in the bottom to direct the wash fluids, namely wash fluid, then spacer fluid, then cement slurry.

FIG. 6*a* shows the generally washed-out casing section (C10) annulus engaged the swab cups of the wash tool (3) near the lower perforations, while cement slurry is being pumped down via the conveying drill pipe string, out between the swab cups, and circulated without excessive force out into the washed-out, preferably spacer fluid primed annulus (C10A) lower portion. Excess cement re-entering above the wash tool may be by-passed down through a bypass channel in the wash tool in order to allow moving the wash tool upwardly while cementing.

FIG. 6*b* illustrates the wash tool having cemented the entire annulus up to the upper portion of the washed-out, now cement slurry filled annulus (C10A). The illustrated length of perforated, washed-out, now cement slurry filled annulus (C10A) is far longer in reality than illustrated here and may be 50 metres or more in order to provide a regulatory required length of cement sealed annulus.

FIG. 6*c* illustrates an embodiment wherein after washing out the annulus (C10A), a casing cutter tool (5) is activated and rotates to cut off the casing (C1) without cutting the second casing (C2). The cut is made in the washed-free casing section (C10) which should now be free of cement in the annulus (C10A). The cut may be made after the step of FIG. 6*b* wherein a cement plug is formed across part of the washed-out annulus (C10A) below the cut to be made, or conducted without any cement plug.

FIG. 6*d* illustrates the further step after the cut is made in FIG. 6*c*, wherein a casing spear (6) has been moved to an upper portion of the cut-off section of casing (C1), and pulled out of hole.

Advantageously the perforation gun (1) is dropped after firing of the shattering device (2). An advantage of dropping the perforation gun (2) and the shattering device (2) is threefold:

a) there will then be no perforation guns or shattering tools to retrieve and disconnect section by section on deck after the pulling out of the drill pipe string and the wash tool (3) after the cementing operation is done. Rig time is saved.

b) There will be no health safety risk from misfired guns or shattering tools upon disconnecting section by section; only the wash tool is retrieved on surface.

c) the guns and shattering tools are disposed of in a lower section of the well such as the rathole below the plugged casing section, if possible, thus not requiring transport away from the platform and subsequent recycling of such potentially hazardous material.

FIG. 7 illustrates the perforated, washed-out section (C10) now plug cemented.

FIG. 8 is, in the upper half, FIG. 8*a*, an illustration of a cross section of the first perforation gun (1) perforating shallowly and only through the first casing (C1), leaving the second casing (C2) generally intact, usually with only minor radial deformation just outside the perforations formed. The shallow range perforation charges (11) are focussed onto the proximal casing wall (C1), and do not focus on, nor perforating the second casing wall (C2). In the lower half, please see FIG. 8*b*, is illustrated the same position of the casing along the well, the same part of the perforated section (C10) wherein is fired the higher-energy slow-burning charges (21) of the shatterer device (2), the second gun (20). The slower-burning charges partly burn into the perforations and further from the perforations into first annulus (C10A) with its cement (101) and cracks it and disintegrates the cement into smaller pieces and also burns around the pieces and also opens up along the cement (101)/casing (C1, C2) interface. The result is illustrated in FIG. 10 below. FIG. 8*c* illustrates an embodiment of the perforation gun (1) combined with a shatterer device (2) constituting one combined perforation and shatterer tool (1, 2). In this embodiment of the invention, the shallow-range perforation charges (11) are triggered, usually by a common ignition cord (111), and perforate, shatter and ignite a surrounding layer comprising a second, slower burning explosive charge (21). The second charge (21) may comprise a cylindrical layer (211) which is fragmented into charge fragments (21F), please see the upper part of FIG. 8*c*. The charge fragments (21F) are partly brought along by the firing of the perforation charges (11) and brought out through the perforations (12) and end up in the annulus (A1). Partly, they remain as a partly or entirely shattered cylindrical layer (211) on the perforation gun. In the lower part of FIG. 8*c*, it is illustrated that those fragments (21F) have been ignited by the energy release of the firing perforation charges (11) and burn slower, but release more energy than the perforation charges (11), into the cemented, now partly cracked up first annulus (A1). The energy release of the charge fragments (21F) further cracks up and disintegrates the cement in the first annulus and partly or entirely releases the cement from the first and second casing. The energy released from the now fragmented layer (211) within the first casing (C1) in the tool's annulus will also contribute to the cracking up of the annular cement in the first annulus (A1).

FIG. 9 is a photographic image with a laboratory experiment having run a perforation gun (1) of an ordinarily perforated dual casing (C1, C2) with cement (101) inbetween, the image showing the inner casing (C1) having been removed after perforation and splitting away of half of the dual casing. It is seen that the annulus cement (101) is intact after shooting and removal of the inner casing. Such a shot casing would not be possible to annulus-cement because the cement is still generally intact between the perforations and is not easily washed out as it is too compact and fluid proof between the holes punched.

FIG. 10 is a photographic image of a perforated and shattered cement according to the invention, here shown in a split outer casing, with the inner casing removed. It is seen that the cement is shattered and disintegrated. The dual casing (C1, C2, and cement (101) is treated according to the present invention: Shallow perforations through inner casing (C1), and the annulus cement (101) shattered using second, slow-burning, energy rich charges which have broken up and disintegrated the first cement (101) between the perforation holes. We see that when the perforated inner casing (C1) is removed from the split setup, the cement is shattered broken up and easily disintegrates. This cement is feasibly washed out using standard wash tool techniques described in relation to FIG. 4 and FIG. 5.

FIG. 11 is also a photographic image corresponding to FIG. 10, with the shattered cement picked away and removed from the annulus within the second casing. One will see that the perforations do not extend through the second casing. The removal of the shattered cement as conducted in this image is a purely mechanical removal which may be done by hand in the situation shown in the picture of FIG. 11, but the corresponding wash-out step as shown in FIGS. 4 and 5 is done using a high pressure wash tool (3). The washing-out procedure may use a washing pressure of up to 1000 Bar or more on the drill pipe string holding the wash tool.

In an embodiment of the invention, one may conduct a disconnecting and dropping procedure of said shatter tool (2) after having detonated it. Such Further, one may conduct disconnecting and dropping of said shatter tool (2) and said perforation gun (1) after having detonated said shatter tool (2), as they are most preferably not retrieved to the surface after firing. This is a safety precaution in case one or more of the charges should have misfired, which has proven highly dangerous when such misfired charges fire on deck.

In an embodiment of the invention, one may arrange said shatter tool's (2) slow-burning higher-energy charges (21) in combination with said perforation gun's (1) shallow-penetrating charges (11) in one common stem, preferably interleavingly, and arranged for firing them in sequence, first, the shallow punching charges (11), then the "shattering" charges (21) with a slight delay so as for the punching charges (11) to have penetrated the inner casing. Please see FIG. 12.

In an embodiment of the invention, one may arrange said shatter tool's (2) slow-burning higher-energy charges (21) in combination with said perforation gun's (1) shallow-penetrating charges (11), please see FIG. 13, in one common stem as discussed under FIG. 8*c*. In an embodiment of the invention, for activating said annulus shattering device (2, 20), one may use a said shatter tool (2) with slow-burning higher-energy charges (21) arranged as a series of single charges (21, 113), please see FIG. 8*c*, said single charges (113) arranged interleaving with said first, shallow-perforating charges (11) within said perforation gun's (1) perimeter, and ignited with a short delay after said first, shallow-penetrating charges (11). The single charges (21, 113) in the form of tablets (113) interleavingly arranged between said first shallow-penetrating charges (11) and arranged for being set off by the energy released by said first charges (11). The perforating charges are arranged in the tool stem and fire through a cylindrical surrounding layer of a second charge (211) which is slower-burning, but has a higher combustion energy than the perforation charges (11). The second charge (211) disintegrates into second charge fragments (21F)

which are brought through the perforations (12) through the first casing (C1) and combust to shatter and disintegrate the annular cement between the first and second casings (C1, C2). In such an embodiment, there is no need for any delay firing device.

| Components list | |
|---|---|
| 0 | drill pipe string (0) |
| 1 | dp conveyed perforation gun (1) |
| 2 | cement shattering device (2) |
| 20 | cement shattering device (20) |
| 11 | shallow-perforating charges (11) |
| 12 | first, shallow perforations (12) in cement-filled casing portion (C10) |
| 3 | annulus washing tool (3) |
| 3S | swivel (3S) |
| 5 | casing cutter tool (5) |
| 6 | casing spear (6) |
| 7 | cementing tool (7) (which may be the washing tool (3)) |
| 8 | Automatic Gun Release (8) |
| 102 | cement (102) in cement-filled casing portion (C10) |
| C10 | cement-filled casing portion (C10) |
| C1 | casing (C1) |
| C10A | first washed-out annulus (C10A) |
| C2 | second casing (C2) to remain intact |

The invention claimed is:

1. A method of annulus cleaning an annulus-cemented casing portion of a first casing in a second casing in a petroleum well, comprising the steps of:

running a drill pipe string-conveyed perforating gun into said well, wherein the perforation gun is run with a cement shattering device and a washing tool into said well;

positioning said perforating gun at said cemented casing portion and activating first, shallow-perforating charges to make first, shallow perforations through said casing portion into a cement-filled annulus portion and leaving said second casing intact;

activating said cement shattering device to provide combustion energy through said shallow perforations to disintegrate all or part of said cement within said first perforated annulus portion; and running the washing tool along said perforated casing portion, washing out all or part of said shattered cement from said perforated annulus portion.

2. The method of claim 1, further comprising the steps of:

running a casing cutting tool into a portion of said perforated, washed-out casing portion, and cutting said first casing; and running a casing spear to set and hold in a top of said perforated, cut-off casing section, and pulling said cut-off casing section out of said second casing and out of hole.

3. The method of claim 1, further comprising the steps of:

assembling said perforation gun with said cement shattering device first;

then, assembling an automatic gun release AGR on said perforation gun;

then, assembling said washing tool on said automatic gun release AGR;

then, assembling a swivel on said washing tool;

then, assembling a rotating casing cutter tool;

then, assembling a casing spear tool;

then, assembling said drill pipe string; and then, running the assembly into the well.

4. The method of claim 1, further comprising the step of:

running a cementing tool and circulating in a cement slurry into at least said washed-out annulus around said perforated casing portion of said well for sealing said annulus.

5. The method of claim 4, wherein said cementing tool is said washing tool.

6. The method of claim 4, further comprising the step of:

conducting said cementing via a cement stinger.

7. The method of claim 4, further comprising the step of:

conducting said cementing via said wash tool, said cementing tool being said wash tool.

8. The method of claim 4, further comprising the steps of:

after having washed said annulus, and optionally having circulated in spacer fluids or primer fluids, with the same wash tool, running into the well for said wash tool acting as a cementing tool to isolate lower perforations of said perforated casing section;

circulating cement slurry through said perforations into said annulus and cementing said annulus, allowing return fluid with displaced wash fluid or other fluids such as spacer or primer fluids from said annulus through perforations above said cementing/wash tool back into the casing bore above the wash tool; and pulling said cementing/wash tool upwardly while cementing, an entire length of said perforated section's annulus, while circulating out wash fluid or other fluids via the first casing.

9. The method of claim 8, further comprising the step of:

allowing cement slurry returning from the annulus being cemented back through perforations above said wash tool to pass downwardly through a bypass channel through said wash tool to allow cementing the casing bore below the wash tool as it is being pulled upwardly during the annulus cementing process.

10. The method of claim 1, wherein after activating said first shallow perforating charges of said perforation gun, displacing said annulus cement shattering device to a position adjacent to said perforations within said perforated casing portion, before said activation of said annulus cement shattering device.

11. The method of claim 1, said annulus cement shattering device comprising a second gun with slower-burning charges detonating in part via said first perforations into said perforated casing portion's annulus.

12. The method of claim 1, wherein said perforating gun and said annulus cement shattering device are combined on the same drill pipe string, with said shattering device below said perforating gun.

13. The method of claim 12, wherein after the step of perforating using the first perforation gun and forming first perforations at perforated casing section:

an ignition cord of said first perforation gun activating a delay timer trigger device;

pulling outwardly to place said annulus cement shattering device within said perforated casing section, within a delay time given by said delay timer trigger device; and said delay timer trigger device triggering said shattering device.

14. The method of claim 1, further comprising the steps of:

using a perforation gun and cement shattering device arranged along a same length of a common stem; and after activating said first, shallow perforating charges of said perforation gun, activating said annulus cement shattering device along the same length of perforations of said perforated casing portion.

15. The method of claim 14, wherein for activating said annulus shattering device, using a said shatter tool with slow-burning higher-energy charges arranged as a cylindrical sleeve around said perforation gun's perimeter, covering and arranged to be broken up into fragments for being displaced partly through said perforations and ignited by said first, shallow-penetrating charges.

16. The method of claim 1, wherein for activating said annulus shattering device, using a said shatter tool with slower-burning higher-energy charges arranged as a series of single charges arranged interleaving with said first, shallow-perforating charges within said perforation gun's perimeter, and ignited with a short delay after said first, shallow-penetrating charges.

17. The method of claim 16, further comprising the step of:

arranging said single charges in the form of tablets interleavingly arranged between said first shallow-penetrating charges and arranged for being set off by the energy released by said first charges.

18. The method of claim 1, further comprising the step of:

using a wash fluid while washing out said shattered cement from said perforated annulus portion, and subsequently using the same wash tool circulating in a spacer fluid into said washed-out perforated annulus portion to prepare the washed-out annulus portion for cementing.

19. The method of claim 1, further comprising the step of:

arranging said wash tool above said first perforation gun.

20. The method of claim 1, further comprising the steps of:

after having detonated said annulus cement shattering device, running into the well for said wash tool to isolate upper or near-upper perforations of said perforated casing section;

normal circulating wash fluid through said perforations into said annulus and washing said annulus, allowing return fluid with washed-out cement and other debris from said annulus through perforations above said wash tool or via perforations below said wash tool and return via a bypass channel through said wash tool; and running downwardly while washing an entire length of said perforated section's annulus, while circulating out disintegrated cement particles and other debris within the first casing.

21. The method of claim 1, wherein said perforation gun, shattering tool, and washing tool are combined in one common tool string.

22. The method of claim 1, further comprising the step of:

using an automatic gun release sub and disconnecting and dropping said shatter tool after having detonated it.

23. The method of claim 1, further comprising the step of:

disconnecting and dropping said shatter tool and said perforation gun after having detonated said shatter tool.

24. A casing annulus cleaning tool string comprising:

a drill pipe string with:

a conveyed perforation gun; and a cement shattering device, wherein both the perforation gun and the cement shattering device are arranged near said drill pipe string's lower end, for being lowered into a casing with an annulus cemented casing portion about said casing in a petroleum well, wherein said perforating gun is arranged with:

first, shallow-perforating charges for shooting first, shallow perforations through said casing portion into a first annulus, said shallow-perforating charges arranged for leaving a surrounding second casing intact;

wherein said shattering device is arranged for being activated after said shallow-perforating charges to provide combustion energy through said shallow perforations to disintegrate all or part of said cement within said first perforated annulus, and wherein a washing tool is arranged above said perforation gun and cement shattering device on said drill pipe string, said washing tool for washing out said shattered cement from said annulus.

25. The casing annulus cleaning tool of claim 24, further comprising:

a casing cutting tool arranged for cutting said first casing;

a casing spear arranged to set and hold in a top of said perforated, cut-off casing section, and adapted for pulling said cut-off casing section out of said second casing and out of hole.

26. The casing annulus cleaning tool of claim 24, further comprising:

an automatic gun release AGR on said perforation gun with said cement shattering device;

said wash tool on said AGR;

a swivel on said wash tool;

a rotating casing cutter tool;

a casing spear tool; and then said drill pipe string.

27. The casing annulus cleaning tool string of claim 24, wherein said washing tool is arranged for circulating in a cement slurry into said washed-out annulus and arranged for sealing said annulus.

28. The casing annulus cleaning tool string of claim 24, wherein said perforation gun and said annulus cement shattering device arranged consecutively, one above the other, wherein said perforation gun is arranged for being triggered first, and wherein said cement shattering device is arranged for subsequentially being displaced to a position adjacent to the firing position, i.e. the perforations of said perforation gun in said perforated casing section, before activation of said annulus cement shattering device.

29. The casing annulus cleaning tool string of claim 24, said annulus cement shattering device comprising a second gun with slower-burning charges arranged for detonating in part via said first perforations into said perforated casing portion's annulus.

30. The casing annulus cleaning tool string of claim 24, wherein said perforating gun and said annulus cement shattering device are combined on a same drill pipe string, with said shattering device below said perforating gun.

31. The casing annulus cleaning tool string of claim 24, comprising:

an ignition cord of said first perforation gun activating a delay timer trigger device arranged for starting a delay time for pulling outwardly to displace said annulus cement shattering device to within said perforated casing section before triggering said shattering device.

32. The casing annulus cleaning tool string of claim 24, wherein said perforation gun and cement shattering device are arranged along the same length of a common stem, and wherein said perforation gun is arranged for firing said first, shallow perforating charges first, making perforations, said annulus cement shattering device arranged for firing subsequently along a same length of perforations of said perforated casing portion.

33. The casing annulus sealing tool string of claim 24, said annulus shattering device comprising slower-burning higher-energy charges as compared with said first charges, said slower-burning higher-energy charges arranged as a cylindrical sleeve around said perforation gun's perimeter, covering said first charges, and arranged to be broken up into fragments by, and partly displaced through said perforations, and to be ignited by said first, shallow-penetrating charges.

34. The casing annulus sealing tool string of claim 24, for activating said annulus shattering device, using a said shatter tool with slow-burning higher-energy charges arranged as a series of single charges arranged interleaving with said first, shallow-perforating charges within said perforation gun's perimeter, and for being ignited with a short delay after said first, shallow-penetrating charges.

35. The casing annulus sealing tool string of claim 24, wherein said wash tool is arranged above said first perforation gun.

36. The casing annulus sealing tool string of claim 24, having the instrument sequence of:

a shattering tool at the bottom of the string;

a perforation gun above said shattering tool or combined with said shattering tool; and a washing tool, with bypass channels, above said perforation gun.

37. The casing annulus sealing tool string of claim 24, an automatic gun release on said shatter tool and or perforation gun disconnectable upon firing of said shatter tool.

* * * * *